US007798490B2

(12) United States Patent
Tamura et al.

(10) Patent No.: US 7,798,490 B2
(45) Date of Patent: Sep. 21, 2010

(54) SHEET CONVEYING APPARATUS, IMAGE FORMING APPARATUS, AND IMAGE READING APPARATUS

(75) Inventors: Ken-ichi Tamura, Toride (JP); Hiromasa Katayama, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 228 days.

(21) Appl. No.: 12/053,872

(22) Filed: Mar. 24, 2008

(65) Prior Publication Data

US 2008/0237979 A1 Oct. 2, 2008

(30) Foreign Application Priority Data

Mar. 28, 2007 (JP) ..... 2007-085849

(51) Int. Cl.
*B65H 7/02* (2006.01)

(52) U.S. Cl. ..... 271/227; 271/228; 271/265.01; 271/265.02; 399/395; 399/396

(58) Field of Classification Search ..... 271/227, 271/228, 265.01, 265.02; 399/395, 396
See application file for complete search history.

(56) References Cited

U.S. PATENT DOCUMENTS 3,907,424 A 9/1975 Komori et al. ..... 355/29
3,999,852 A 12/1976 Katayama et al. ..... 355/26
4,032,137 A 6/1977 Katayama et al. ..... 271/164
5,156,391 A * 10/1992 Roller ..... 271/227
5,678,159 A * 10/1997 Williams et al. ..... 399/395
5,697,608 A * 12/1997 Castelli et al. ..... 271/228
6,269,995 B1 * 8/2001 Rich et al. ..... 226/17
6,826,384 B2 * 11/2004 Dobbertin et al. ..... 399/394

FOREIGN PATENT DOCUMENTS

JP 4-277151 A 10/1992
JP 2000-143036 5/2000

* cited by examiner

*Primary Examiner*—Saúl J Rodríguez
*Assistant Examiner*—Luis Gonzalez
(74) *Attorney, Agent, or Firm*—Fitzpatrick, Cella, Harper & Scinto

(57) ABSTRACT

A sheet conveying apparatus, an image forming apparatus, and an image reading apparatus are capable of stably correcting the delay or the advance of a sheet even if sheet conveying rollers such as a skew feeding correction roller and the like are decentered. The delay amount or the advance amount of the sheet being conveyed is detected by a deviation amount detection unit and a control amount setting unit sets the sheet conveying speed and the correction time of a sheet conveying roller which corrects the delay or the advance of the sheet based on the delay amount or the advance amount of the sheet detected by the deviation amount detection unit. The control amount setting unit sets the sheet conveying speed and the correction time of the sheet conveying roller so that the delay or the advance of the sheet is corrected when the sheet conveying roller rotates integer multiple.

6 Claims, 11 Drawing Sheets

SHEET CONVEYING APPARATUS, IMAGE FORMING APPARATUS, AND IMAGE READING APPARATUS

BACKGROUND OF THE INVENTION

1. Field of the Invention

The present invention relates to a sheet conveying apparatus, an image forming apparatus, an image reading apparatus, and, more particularly, to an arrangement for correcting an advance and a delay of a sheet being conveyed.

2. Description of the Related Art

In a conventional image forming apparatus and image reading apparatus such as a copy machine, a printer, a scanner, and the like, a sheet conveying apparatus is attached to an image forming unit and an image reading unit to convey sheets such as recording materials, originals, and the like. The sheet conveying apparatus may be provided with a registration correction unit for correcting an advance and a delay of a sheet being conveyed so that the sheet reaches to the image forming unit and the image reading unit at a predetermined timing and with a skew feeding correction unit for aligning the attitude of the sheet.

There may be provided a detection unit as the registration correction unit to recognize a sheet conveying speed and a sheet position. Then, there is such a proposal for causing a sheet to reach to a predetermined position at a predetermined timing by controlling the sheet conveying speed of a conveying roller and a belt based on the signal from the detection unit.

For example, in an original feeder serving as the sheet conveying apparatus disposed to the image reading apparatus, after documents stacked on an original tray are fed by a pick-up roller, they are separated one by one in a separation unit and then conveyed to a reading unit by a conveying roller.

When an original is conveyed as described above, a registration correction unit disposed to the original feeder first predicts a time at which the original reaches to an image reading unit by recognizing a sheet conveying speed and a passing-through time by a conveying delay amount measurement sensor and an original extreme end detection sensor which come into contact with the original.

Then, the sheet conveying speed of the conveying roller is increased or decreased to correct the difference between the predicted reach time and a regular reach time so that the original reaches to the image reading unit at a predetermined timing by controlling the sheet conveying speed as described above (refer to, for example, Japanese Patent Application Laid-Open No. 2000-143036).

There are several systems serving as a skew feeding correction system of the skew feeding correction unit. One of the systems is arranged such that the extreme end of a sheet is abutted against the nip of a pair of rollers at rest and flexed so that the skew feeding of the sheet is corrected by causing the extreme end of the sheet to be aligned with the roller nip by the elasticity of the sheet. Further, when the roller is rotated at the timing at which a toner image on an image bearing member is transferred to a proper position of the sheet, a registration can be also performed in addition to the skew feeding.

Note that there is also another system arranged such that a shutter member for stopping the extreme end of a sheet is disposed at a midpoint of a sheet conveying path so as to be evacuated, and after the extreme end of the sheet is aligned with the shutter member, it is evacuated from the sheet conveying path to thereby correct skew feeding.

However, in these systems, the interval between sheets, that is, a so-called sheet distance is increased because it is necessary to stop the sheet once to correct the registration and the skew feeding, and thus the throughput during image formation and the like is lowered.

To cope with this problem, there is recentl proposed an active skew feeding correction system for correcting skew feeding while conveying a sheet without stopping it once to increase the throughput of image formation and the like image (refer to, for example, Japanese Patent Application Laid-Open No. 4-277151).

In the active skew feeding correction system, two sensors are disposed in a sheet conveying path so as to be separated form each other a predetermined distance in a width direction orthogonal to a sheet conveying direction and detect the inclination (skew feeding) of the extreme end of a sheet based on a signal illustrating that the extreme end of the sheet traverses the respective sensors. Thereafter, the skew feeding of the sheet is corrected by controlling sheet conveying speed of skew feeding correction rollers disposed in the width direction at a predetermined interval and driven independently.

However, in the sheet conveying apparatus provided with the conventional registration correction unit and the conventional skew feeding correction unit, a conveying roller and a skew feeding correction roller may be decentered by an assembly accuracy and variation per hour. When the conveying roller and the skew feeding correction roller are decentered as described above, the distance from the center of revolution and a sheet contact surface of the rollers is varied, thereby the sheet conveying speed of the conveying roller is changed at the cycle of the skew feeding roller when it is rotated once even if it rotates at a predetermined angular speed as illustrated in FIG. 9. That is, when the conveying roller and the skew feeding correction roller are decentered, they rotate irregularly and thus a sheet is conveyed at an irregular conveying speed.

Since a correction distance is the product of a sheet conveying speed V2 and a time T, even if a time T1 and time T2 illustrated in FIG. 9 are equal to each other, the areas (correction distances) in the two times T1, T2 are different from each other. Accordingly, when various types of corrections are performed by increasing or decreasing the number of revolutions of the roller, even if the angular speed, that is, the number of revolutions of a drive system is changed, a sheet is affected by the amount of dispersion of the sheet conveying speed due to the position at which the correction roller comes into contact with the sheet, and the amount of correction is also dispersed at the ratio.

When, for example, the skew feeding of a sheet is corrected by two skew feeding correction rollers, it is assumed that a skew feeding correction roller 300 illustrated in FIG. 10 has a diameter of 40 mm, a sheet conveying speed of 500 mm/second, and a correction time of 0.1 second. Further, it is assumed that the deviation of a conveying surface is 0.2 mm with respect to a roller axis 301, that is, the surface of the roller is deviated from the center of the roller axis 301 by 0.1 mm at the maximum.

In order to correct a skew feeding amount of 5 mm by one of the skew feeding correction rollers in this state, that is, in order to cause a delayed side to catch up to a not delayed side in the correction time of 0.1 second, the sheet conveying speed of the one skew feeding correction roller 300 must be increased by 50 mm/second (=5 mm÷0.1 second). That is, the skew feeding correction roller 300 on the delayed side must be driven so that the conveying speed thereof is increased to 550 mm/second.

Here, the angular speed of the skew feeding correction roller 300 at the speed of 550 mm/second is 1575.6°/second (550 mm/second÷(40 mm×π)×360°=1575.6°/second.

Accordingly, the amount of revolution of the skew feeding correction roller 300 in the actual correction time of 0.1 second is 157.56° (1575.6°/second ×0.1 second=157.56°).

At this time, the sheet conveying speed in the vicinity of a position A (position farthest from the roller axis 301) of the skew feeding correction roller 300 and the sheet conveying speed in the vicinity of a position B position (position nearest from the roller axis 301) of the skew feeding correction roller 300 are as illustrated below.

When the speed is fastest (in the vicinity of the position A): 55.195 mm When the speed is slowest (in the vicinity of the position B): 54.8026 mm Then, the difference therebetween is as follows as illustrated in a part (a) of FIG. 10.

$$\Delta L=55.195-54.8026=0.3924 \text{ mm}$$

Note that when the skew feeding correction roller 300 is a not decentered skew feeding correction roller as illustrated in a part (b) of FIG. 10, the difference between the sheet conveying speeds due to the difference of the phases of the roller is 0 mm. That is, when the skew feeding correction roller 300 is decentered, there is a possibility that an unexpected deviation of 0.3924 mm may occur at the maximum when the skew feeding of 5 mm is corrected. This value cannot be neglected in view of the positional accuracy when a formed image is allocated to a sheet.

Note that although the position of a sheet may be continuously detected by a line sensor and the like to eliminate the adverse effect due to the decentering of the skew feeding correction roller 300, a cost is increased in this case.

The present invention was made in view of the above circumstances and provides a sheet conveying apparatus, an image forming apparatus, and an image reading apparatus capable of stably correcting a delay or an advance of a sheet even if sheet conveying rollers such as a skew feeding correction roller and the like are decentered.

SUMMARY OF THE INVENTION

In a sheet conveying apparatus having a sheet conveying roller for conveying a sheet and correcting a delay or an advance of the conveyed sheet by increasing or decreasing the sheet conveying speed of the conveying roller, the sheet conveying apparatus includes a deviation amount detection unit for detecting a delay amount or an advance amount of the conveyed sheet, and a control amount setting unit for setting, when the delay or the advance of the sheet is corrected, the sheet conveying speed and the correction time of the sheet the conveying roller based on the delay amount or the advance amount of the sheet detected by the deviation amount detection unit, wherein when the sheet conveying roller rotates integer multiple, the control amount setting unit sets the sheet conveying speed and the correction time of the conveying roller so that the delay or the advance of the sheet is corrected.

When the sheet conveying speed and the correction time of the sheet conveying roller are set so that the delay or the advance of a sheet is corrected when the sheet conveying roller rotates integer multiple as in the present invention, the delay or the advance of the sheet can be stably corrected even if the roller is decentered.

Further features of the present invention will become apparent from the following description of exemplary embodiments with reference to the attached drawings.

DESCRIPTION OF THE EMBODIMENTS

A best mode for carrying out the present invention will be described below in detail using the drawings.

Figure 1:
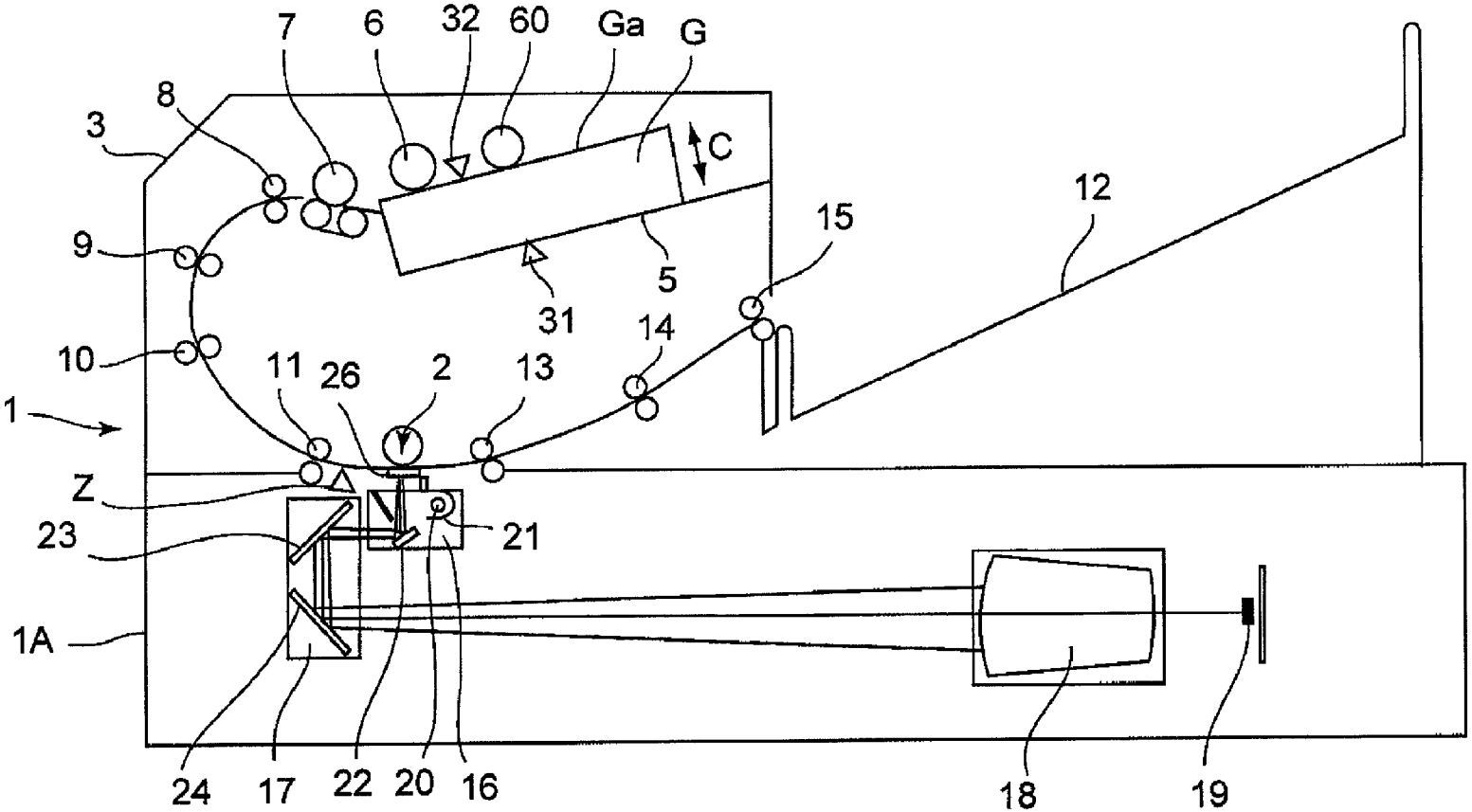
FIG. 1 is a view illustrating a schematic arrangement of an image reading apparatus having a sheet conveying apparatus according to a first embodiment of the present invention.

FIG. 1 is a view illustrating a schematic arrangement of an image reading apparatus having a sheet conveying apparatus according to a first embodiment of the present invention. In FIG. 1, an image reading apparatus 1 includes an automatic document feeder (ADF) 3 as an example of the sheet conveying apparatus and an image reading unit 1A for converting an original image into image data.

In the image reading apparatus 1, when an original image is read, first, documents G are stacked on a stack tray 5 of the automatic document feeder 3, and a not shown operation portion instructs to begin to read an image. With this operation, an exposure lamp 20 is turned on to make preparation for reading the image. Further, the stack tray 5, which has been moved to a waiting position, is driven by a not shown drive unit and begins to move upward in response to a signal from a lower limit sensor 31, and when the uppermost document Ga of the stacked documents G is detected by a sheet surface height sensor 32, the upward movement of the stack tray 5 is stopped.

Thereafter, the uppermost document Ga is fed in such a manner that a pick-up roller 6 falls from a waiting position spaced apart from the originals G onto the uppermost document Ga of the originals G and is rotated. Then, the uppermost document Ga fed as described above is separated by a separation unit 7, and only the uppermost document Ga is conveyed to an image reading position 2 by an extraction roller 8, conveying rollers 9, 10, and a registration correction roller 11. Note that when the originals G are conveyed to the image reading position 2 as described above, the pick-up roller 6 moves upward to the waiting position again.

Next, when the uppermost document Ga passes through the image reading position 2, the original Ga is illuminated by the exposure lamp 20 through a contact glass 26. Then, the light reflected from the original Ga is guided to a lens 18 through mirrors 22 to 24, imaged on a CCD sensor 19, converted into an electronic signal by the CCD sensor 19 thereafter, and processed by a not shown video processing unit through a not shown amplification circuit.

Next, after the original Ga passes through the image reading position 2, it is further conveyed to a downstream side by conveying rollers 13 to 15 and discharged to a discharge tray 12. The series of these operations is repeated until the originals G are entirely eliminated from the stack tray 5.

Note that the height of the uppermost document Ga of the original bundle is kept constant at all times by the sheet surface detection sensor 32 and a not shown stack tray drive unit during the sheet feed operation. Further, when the originals G are entirely eliminated from the stack tray 5, the stack tray 5 moves downward to the waiting position, the sheet feed operation is finished, and the exposure lamp 20 is turned off.

Incidentally, in the image reading apparatus 1, when the original Ga is conveyed to the image reading position 2 faster than a regular time, if preparation of the video processing performed by the image reading unit 1A is not finished, an image is not read correctly. Further, when the original Ga is conveyed to the image reading position 2 later than the regular time, a period of time necessary to an image read processing is increased and thus productivity is deteriorated.

Figure 2:
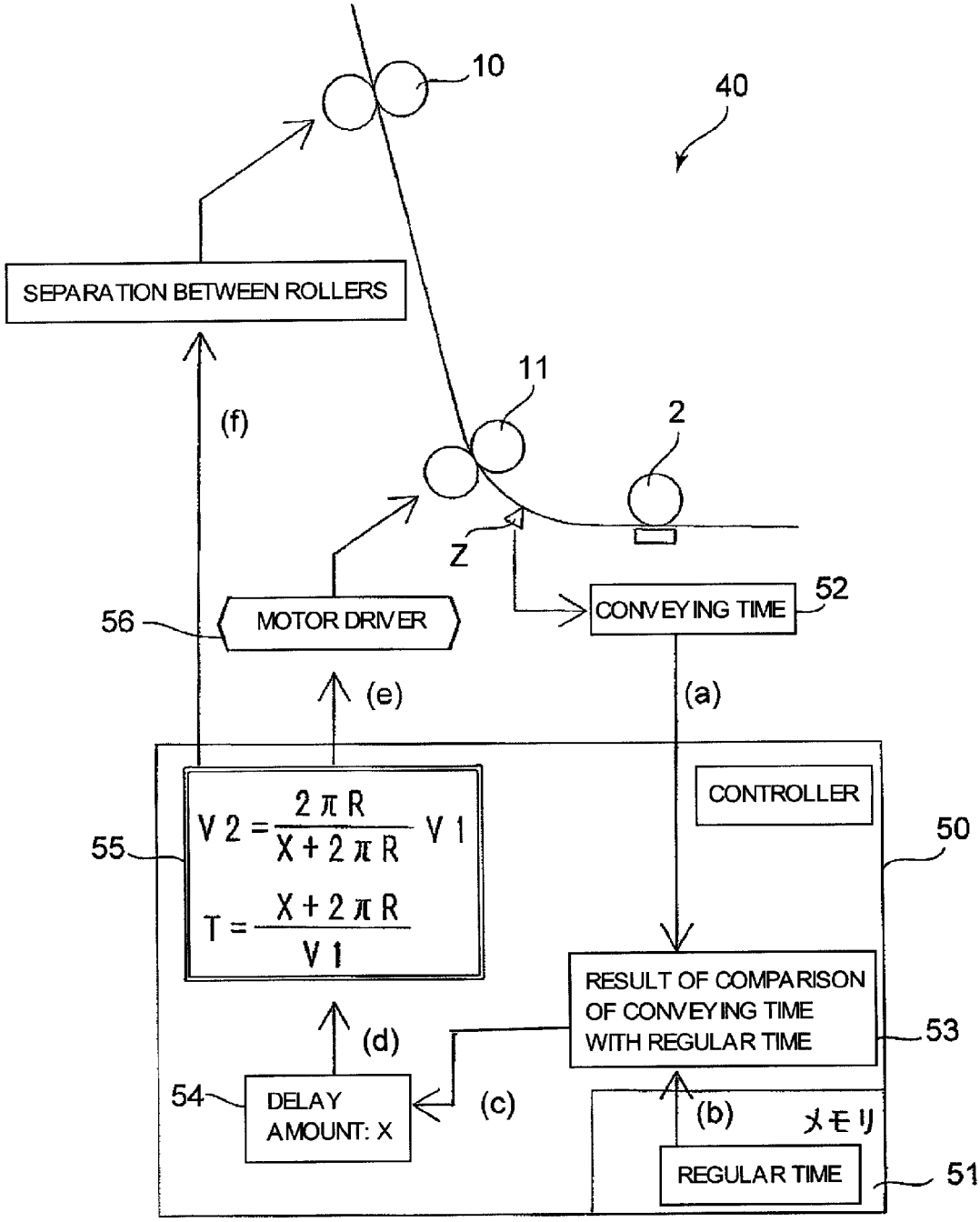
FIG. 2 is a block diagram illustrating an arrangement of a registration correction unit disposed to the sheet conveying apparatus and a flow of a signal.

To cope with the above problem, when the originals G are conveyed to the image reading position 2 by the automatic document feeder 3, the originals G are conveyed to the image reading position 2 at a regular timing by a registration correction unit 40 illustrated in FIG. 2.

The registration correction unit 40 includes a registration correction roller (hereinafter, called a correction roller) 11 as a sheet conveying roller and an original extreme end detection sensor Z disposed in a conveying path on the downstream side of the correction roller 11. Further, the registration correction unit 40 is provided with a controller 50 for increasing or decreasing the original conveying speeds of the correction roller 11 and the conveying roller 10 and the like upstream of the correction roller 11 based on the signal from the original extreme end detection sensor Z.

Note that the controller 50 controls the entire image reading operation of the image reading apparatus 1 including the registration correction performed by the registration correction unit 40. Further, the controller 50 is provided with a memory 51 which stores the value of the time detected by the original extreme end detection sensor Z when the extreme end of the original is regularly conveyed.

Note that, in FIG. 2, a motor driver 56 drives a not shown motor for rotating the correction roller 11 based on the control signal from the controller 50.

Next, a registration correcting operation in the registration correction unit 40 arranged as described above will be described.

First, the time at which the extreme end of the original is conveyed (passing time) by the correction roller 11 is detected by the original extreme end detection sensor Z so that the original can be conveyed to the image reading position 2 at the regular timing. Then, the signal detected by the original extreme end detection sensor Z is input to a conveying time detection unit 52, and the conveying time detection unit 52 detects the conveying time of the extreme end of the original based on the signal detected by the original extreme end detection sensor Z.

Next, the conveying time of the extreme end of the original detected as described above is input from the conveying time detection unit 52 to a comparison unit 53 disposed in the controller as illustrated in (a) of FIG. 2. At this time, a regular time when the original is regularly conveyed, which is previously stored to the memory 51, is input to the comparison unit 53 as illustrated in (b) of FIG. 2.

Then, the comparison unit 53, which is a deviation amount detection unit for detecting the delay amount or the advance amount of the original being conveyed, compares the conveying time with the regular time, and the difference between the two times is recognized as a delay time Tx or an advance time Tx.

When it is presumed that an original being conveyed is conveyed to a previously determined position in a predetermined time, the delay amount or the advance amount of the original being conveyed means a deficit amount or a surplus amount to the presumed position. The amount is calculated by the following method.

Figure 3:
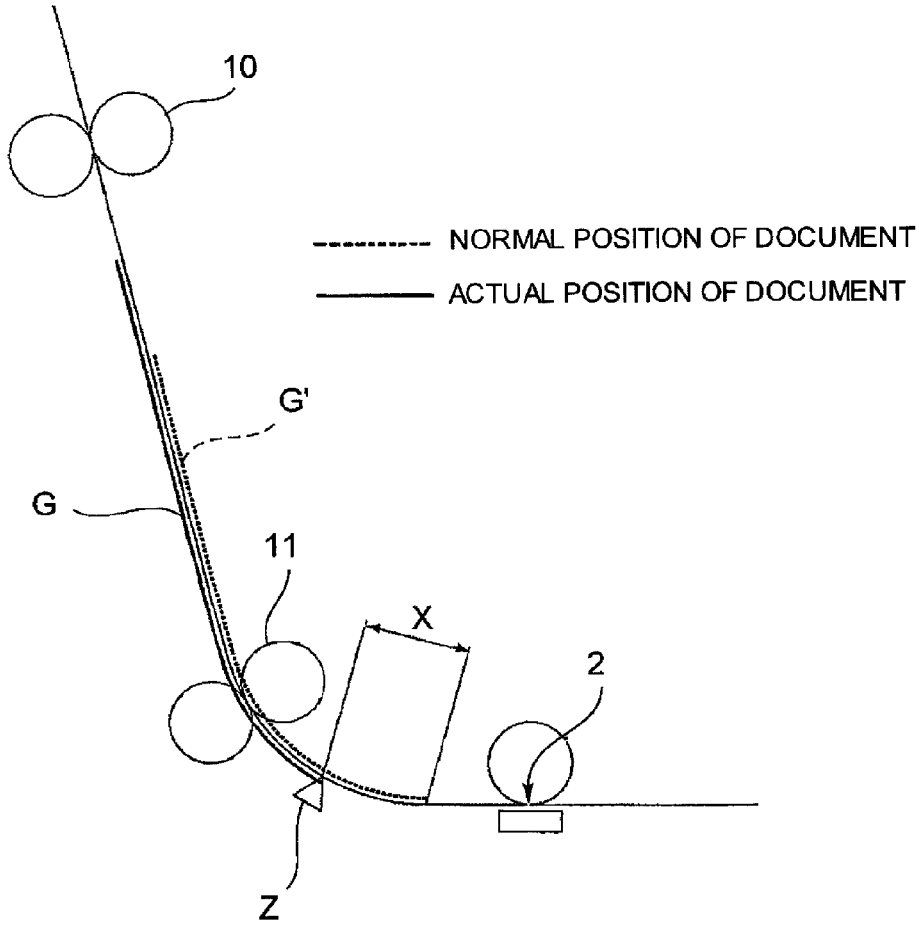
FIG. 3 is a view describing the delay amount of an original in an automatic document feeder as an example of the sheet conveying apparatus.

Next, the difference, which is a result of comparison of the conveying time and the regular time, is input to a conversion unit 54 as illustrated in (c) of FIG. 2, and the delay amount (or the advance amount) X is converted from the relation between the recognized delay time (or the advance time) Tx and a conveying speed V1 by the conversion unit 54. Note that a case that an original being conveyed is delayed than the regular time will be described. In this case, the extreme end position of an original G' illustrated by a broken line in FIG. 3 whose position is a position where it is to be primarily located and the extreme end position of an original G illustrated by a solid line whose position is an actual position has a difference X as illustrated in FIG. 3.

Next, the delay amount X converted by the conversion unit 54 as described above is input to a control amount setting unit 55 as illustrated in (d) of FIG. 2. Then, the control amount setting unit 55 sets an original (sheet) conveying speed (hereinafter, called a corrected conveying speed) V2 and a correction time T in an operation for correcting the correction roller 11 using expressions (3) and (4) to be described later so that the delay or the advance of the original is corrected.

Figure 4:
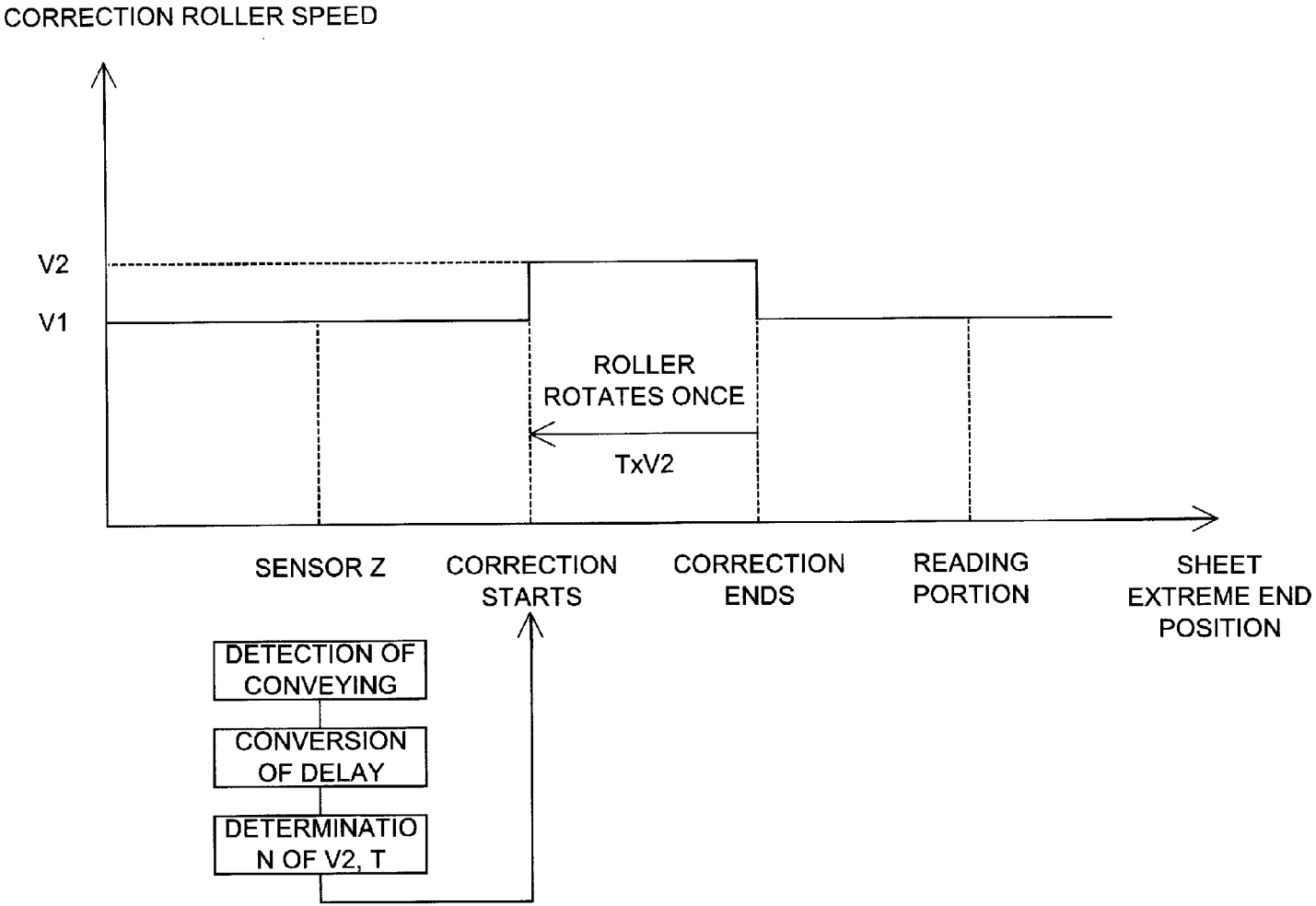
FIG. 4 is a view describing the original conveying speed and the correction time of a correction roller set by the registration correction unit.

Next, as illustrated in (e) of FIG. 2, a control signal is input to the motor driver 56 based on a result of the setting performed by the control amount setting unit 55, and the correction roller 11 is driven through the motor driver 56. With this operation, the sheet conveying speed of the correction roller 11 is changed from the original conveying speed V1 before the delay amount or the advance amount is detected (before a skew feeding correction operation) to the corrected conveying speed V2 only during the correction time T as illustrated in FIG. 4. As a result, an original P can be fed to the image reading position 2 at the regular time.

At this time, when necessary, the control amount setting unit 55 outputs a control signal to, for example, the conveying roller 10 located upstream of the correction roller 11 to increase the distance between the rollers or the original conveying speed of the conveying roller 10 a little more than the correction roller 11 so that the speed change of the correction roller 11 is not interfered with.

Incidentally, when the control amount setting unit 55 sets the corrected conveying speed V2 and the correction time T, the original conveying speed V1 before the delay amount or the advance amount is detected, the corrected conveying speed V2, the delay distance X, and the correction time T are controlled so that the relation therebetween satisfies the following expression. Note that X is set to a negative value when the original is delayed and to a positive value when the original is advanced.

$$V1T-V2T=(V1-V2)T=X \quad (1)$$

When the correction roller 11 is decentered, the original is affected by the amount of dispersion of the conveying speed caused by the position at which the original is in contact with the correction roller 11 as described already. That is, when the correction roller 11 is decentered, a peripheral speed is varied even if an angular speed is unchanged, even if the conveying speed is changed to the corrected conveying speed V2, the conveying speed is dispersed by the position of a roller surface in contact with the original.

However, even if the correction roller 11 is decentered, the convey distance of the correction roller 11 when it rotates once is unchanged at all times. Thus, in the embodiment, the delay of the original is corrected using the outer peripheral surface of the correction roller 11 when it rotates once so that the dispersion of the corrected conveying speed caused by the position of the roller surface can be prevented even if the correction roller 11 is decentered. That is, the correction time T is set as a time necessary to correct the delay of the original using the outer peripheral surface of the correction roller 11 when it rotates once so that the delay of the original can be completely finished within the correction time T.

The relation between the corrected conveying speed V2 and the correction time T at this time is represented by the following expression.

$$T=2n\pi R/V2 \ldots \text{(n is an integer)} \quad (2)$$

That is, the control amount setting unit 55 determines the correction time T and the corrected conveying speed V2 that satisfy the expressions (1) and (2), and the delay of the original is recovered by driving the correction roller 11 by the values, thereby the original can be conveyed to the image reading position at the regular time.

When it is assumed that n is 1, the following expressions (3), (4) can be obtained from the expressions (1), (2).

$$V2 = \frac{2\pi R}{X + 2\pi R} V1 \quad (3)$$

$$T = \frac{X + 2\pi R}{V1} \quad (4)$$

Next, an example when the correction is performed using the expressions (3) and (4) will be described.

When it is assumed that the original conveying speed V1 before the delay amount or the advance amount is detected is 500 mm/second, the radius of the correction roller 11 is 20 mm, and the delay amount X is −5 mm, the corrected conveying speed V2 and the correction time T at this time are as represented below from the expressions (3) and (4).

$$V2=520.7 \text{ mm/second}$$

$$T=0.241 \text{ second}$$

The delay of the original P can be corrected by the roller surface when the correction roller 11 rotates once by conveying the original P at the corrected conveying speed V2 (=520.7 mm/second) during the correction time T (=0.241 second) as illustrated in FIG. 4. With this operation, the registration of the original can be corrected without being affected by the variation of the original conveying speed caused by the decentering of the correction roller 11.

As described above, even if the correction roller 11 is decentered, the delay or the advance of the original can be stably corrected by setting the original conveying speed V2 and the correction time T of the correction roller 11 so that the delay or the advance of the sheet can be corrected when the correction roller 11 rotates once. Since the adverse affect due to the decentering of the correction roller 11 is eliminated as described above, a line sensor and the like for continuously detecting the position of the original becomes unnecessary, thereby a cost can be reduced and a performance can be improved at the same time. Further, the quality of read data can be improved in the image reading apparatus 1.

Note that, in the above explanation, the original conveying speed V2 and the correction time T of the correction roller 11 are set so that the delay or the advance can be corrected when the correction roller 11 rotates once. However, the present invention is not limited thereto, and the original conveying speed V2 and the correction time T of the correction roller 11 may be set so that the delay or the advance is corrected when the correction roller 11 rotates integer multiple.

Further, although the registration correction unit 40 disposed to the automatic document feeder 3 is described in the embodiment, the embodiment can be also applied to, for example, a registration correction unit used to the positional alignment of a sheet with a toner image on an image bearing member in an image transfer portion of an image forming apparatus.

Next, a second embodiment of the present invention will be described.

Figure 5:
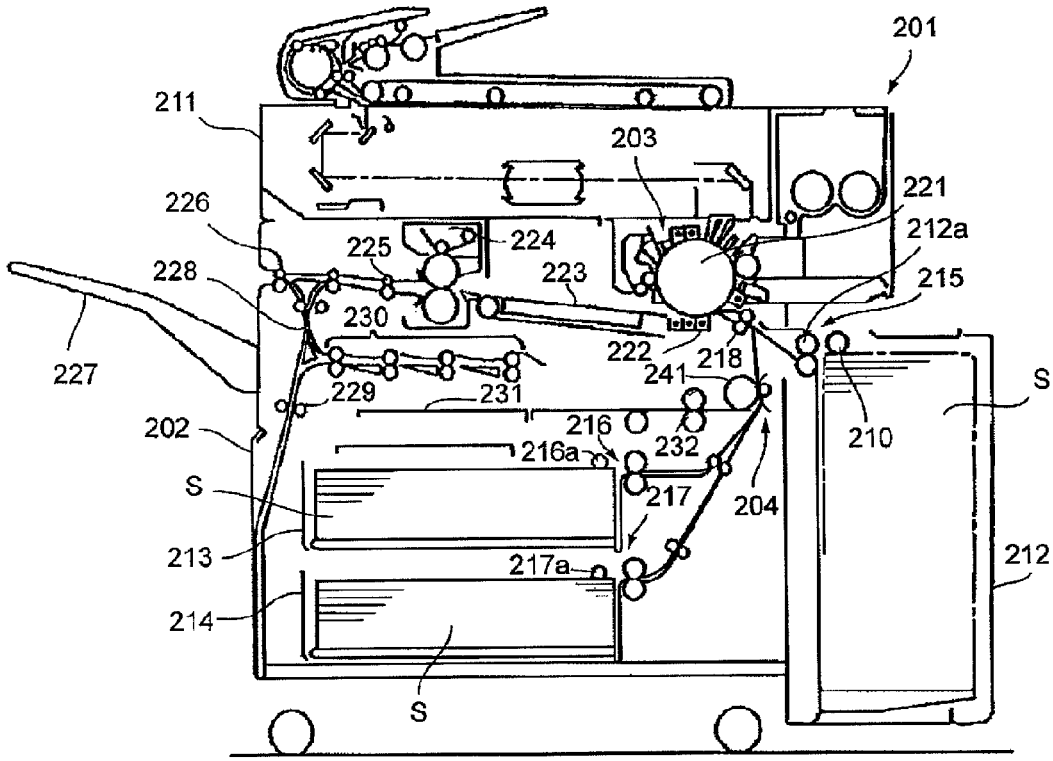
FIG. 5 is a schematic arrangement view of a printer as an example of the image forming apparatus having a sheet conveying apparatus according to a second embodiment of the present invention.

FIG. 5 is a schematic arrangement view of a printer 201 as an example of the image forming apparatus having a sheet conveying apparatus according to the second embodiment.

In FIG. 5, the printer 201 includes a printer main body 202, a scanner 211 disposed on the upper surface of the printer main body 202, and a feed deck 212 which is disposed on a side of the printer main body 202 and on which a lot of sheets S are stacked and accommodated.

The printer main body 202 includes an image forming unit 203 provided with a photosensitive drum 221 as an image bearing member, and retard separation type sheet feeders 216, 217 for feeding the sheets S. Further, the printer main body 202 includes the sheet conveying apparatus 204 for conveying the sheets S fed by the sheet feeders 216, 217 to an image forming unit 203.

The sheet feeders 216, 217 include cassettes 213, 214 on which a predetermined amount of the sheets S are stacked and accommodated, feed rollers 216*a*, 217*a*, and the like. Further, the sheet conveying apparatus 204 includes a conveying roller 241 and a skew feeding correction unit 218 so that the sheets S fed from the sheet feeders 216, 217 are guided to the skew feeding correction unit 218 by the conveying roller 241. Note that the sheets accommodated on the feed deck 212 are guided to the skew feeding correction unit 218 by a retard separation type sheet feeder 215 and a conveying roller 212*a*.

After the skew feeding of a sheet S is corrected by the skew feeding correction unit 218 as described later, the sheet S is sent to a transfer portion composed of the photosensitive drum 221 of the image forming unit 203 a transfer charger 222, and a toner image previously formed on the photosensitive drum 221 is transferred onto the sheet S. Thereafter, the sheet S, onto which the toner image is transferred, is further sent to a fixing unit 224 by a conveyor belt 223, and the transferred toner image is fixed on the surface of the sheet by the fixing unit 224.

The printer 201 has a both-surface copy mode for performing a both-surface copy to the sheets S and a multiple-copy mode for performing a multiple-copy. In an ordinary copy mode (single-surface copy mode), the sheet S subjected to the fix processing is discharged onto a discharge tray 227 outside of the machine by a discharge roller pair 226.

Further, in the both-surface copy mode and the multiple-copy mode, the sheets S are temporarily stacked and accommodated on an intermediate tray 231 by an internal discharge roller pair 225 or a switch back roller pair 229 through a sheet re-feeding path 228 and a both-surface conveying path 230.

Thereafter, the sheets S accommodated on the intermediate tray 231 are conveyed to the skew feeding correction unit 218 by a refeeder 232 to form an image thereon again and then discharged to the outside of the machine through the same process as the single-surface copy.

Figure 6:
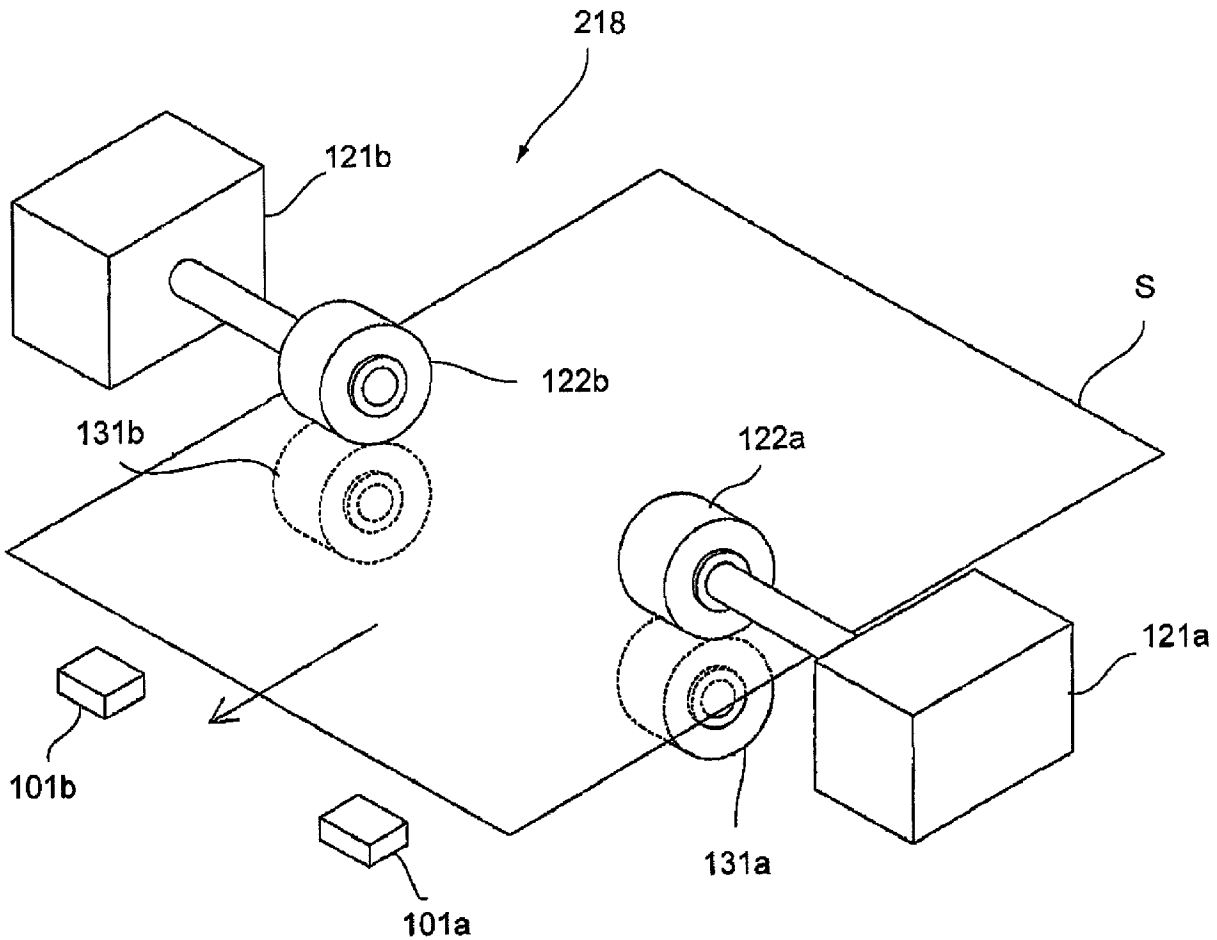
FIG. 6 is a view illustrating an arrangement of a skew feeding correction unit disposed to the sheet conveying apparatus of the printer.

FIG. 6 is a perspective view of the skew feeding correction unit 218. In FIG. 6, two optical type sheet extreme end detection sensors 101*a*, 101*b* acting as detection sensors are disposed in a width direction in a sheet conveying path at predetermined intervals and detect the extreme end of a sheet, respectively. A plurality of (two) skew feeding correction rollers 122*a*, 122*b* acting as sheet conveying rollers are disposed coaxially in the width direction and independently driven in revolution, respectively by pulse motors 121*a*, 121*b* as drive sources.

Further, driven rollers 131*a*, 131*b* are caused to come into pressure contact with the skew feeding correction rollers 122*a*, 122*b* by a not shown pressure unit, and the driven roller 131*a*, 131*b* are ordinarily rotated following to rotation of the skew feeding correction rollers 122*a*, 122*b*, respectively. As described already, a sheet S conveyed by the sheet feeders 215 to 217 is conveyed while causing the driven roller 131*a*, 131*b* to be rotated following to rotation of the skew feeding correction rollers 122*a*, 122*b*.

Figure 7:
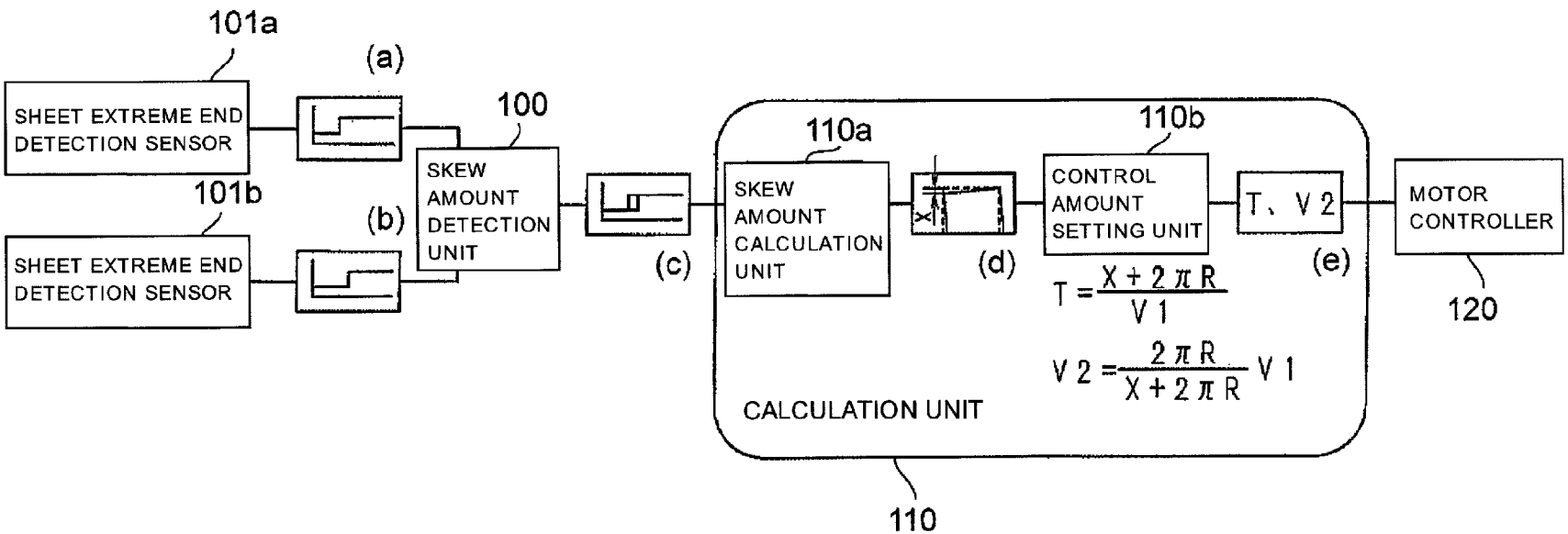
FIG. 7 is a control block diagram of the skew feeding correction unit.

FIG. 7 is a control block diagram of the skew feeding correction unit 218 arranged as described above. In FIG. 7, a skew feeding amount detection unit 100 detects the skew feeding amount as the delay or the advance of the sheet being conveyed based on the signals from the two sheet extreme end detection sensors 101*a*, 101.

A calculation unit 110 corrects the skew feeding of the sheet by detecting the skew feeding amount thereof based on the signal from the skew feeding amount detection unit 100. The calculation unit 110 controls the sheet conveying speeds of the skew feeding correction rollers 122*a*, 122*b* based on the calculated skew feeding amount through the pulse motors 121*a*, 121*b*.

Next, a skew feeding correction operation in the skew feeding correction unit 218 arranged as described above will be described.

First, when the extreme end of the sheet S conveyed from downstream by the sheet feeders 215 to 217 traverse the sheet extreme end detection sensors 101*a*, 101*b*, the sheet extreme end detection sensors 101*a*, 101*b* output signals illustrating that the sheet traverses them to the skew feeding amount detection unit 100.

When the extreme end of the sheet traverses the sheet extreme end detection sensors 101*a*, 101*b* at a different timing, detection signals are output from the sheet extreme end detection sensors 101*a*, 101*b* to the skew feeding amount detection unit 100 at a different timing as illustrated in (a) and (b) of FIG. 7. When the detection signals are output at the different timing as described above, the skew feeding amount detection unit 100 inputs an instantaneous skew detection signal to the calculation unit as illustrated in (c) of FIG. 7.

Figure 8:
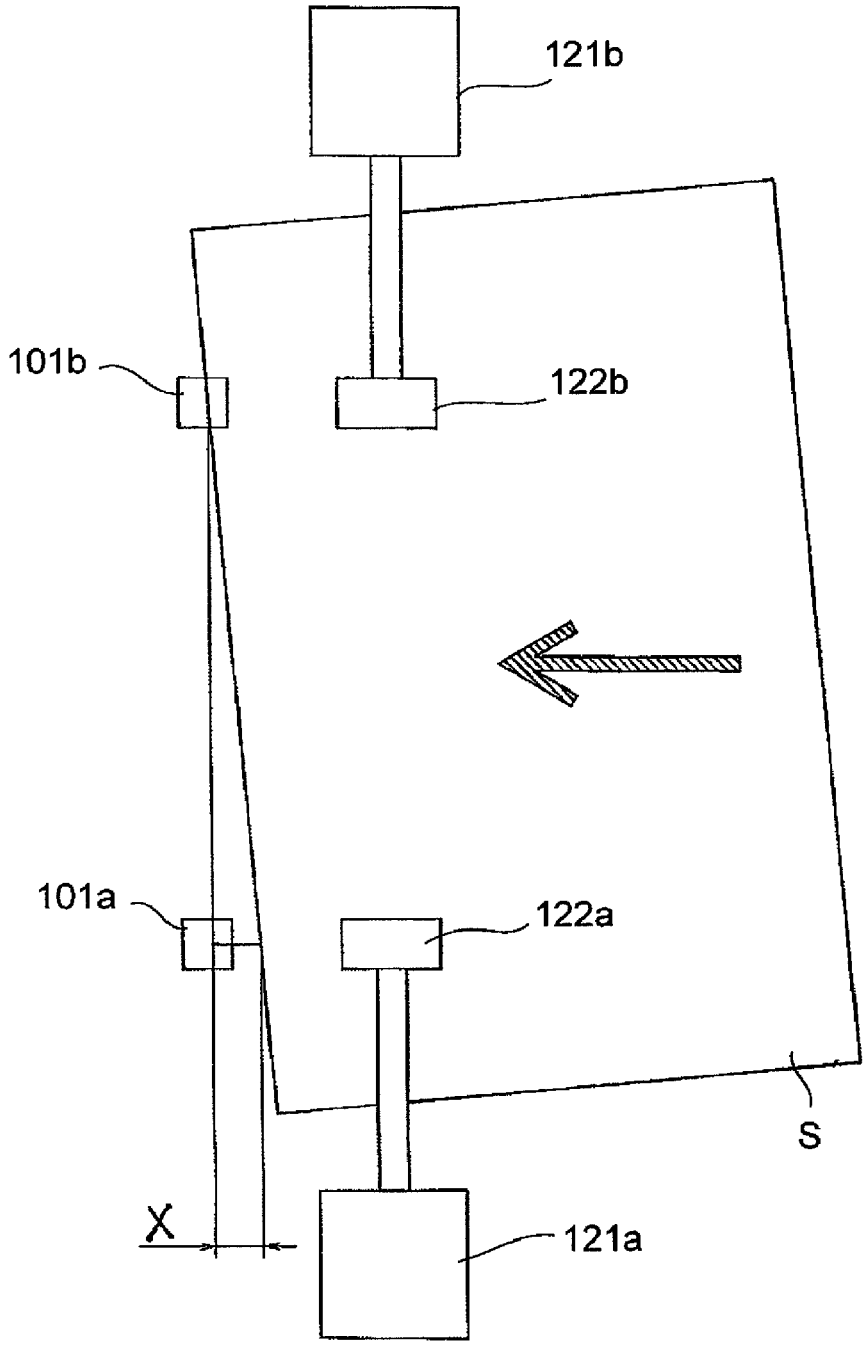
FIG. 8 is a view illustrating a state that a skew-fed sheet passes through the skew feeding correction unit.
Figure 9:
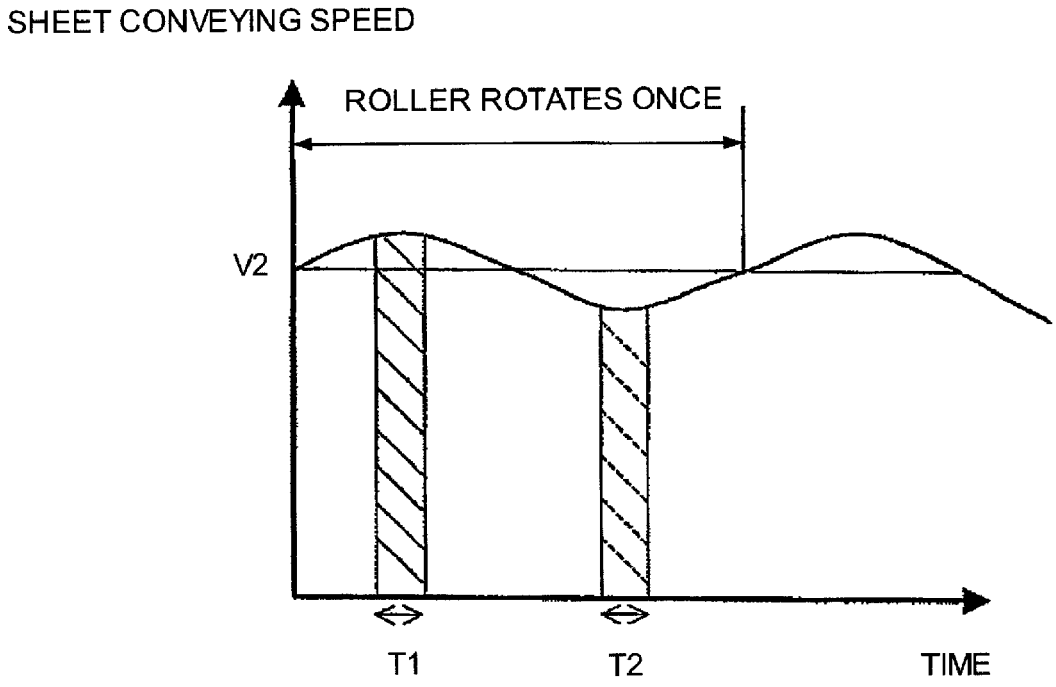
FIG. 9 is a view illustrating a change of a sheet conveying speed caused by a conventional decentered correction roller.
Figure 10A:
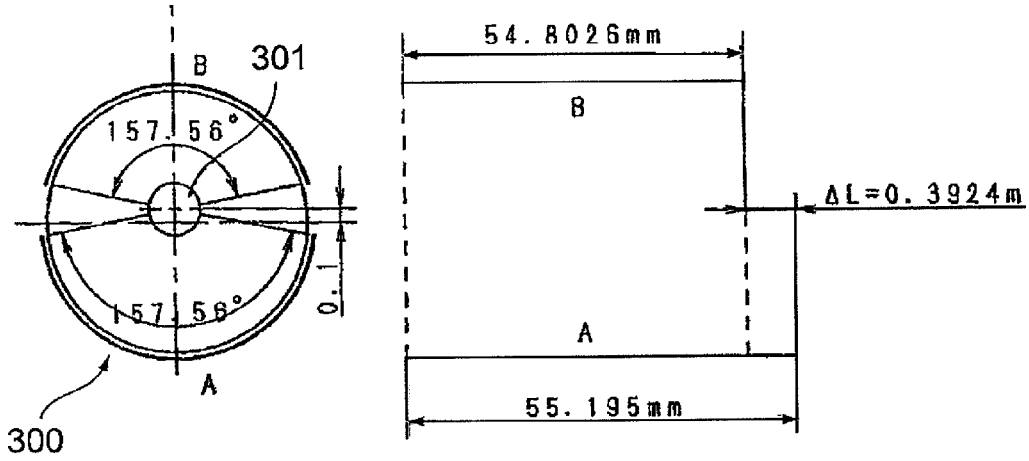
FIGS. 10A and 10B are views describing that the sheet conveying speed is changed by the phase of the conventional correction roller.
Figure 10B:
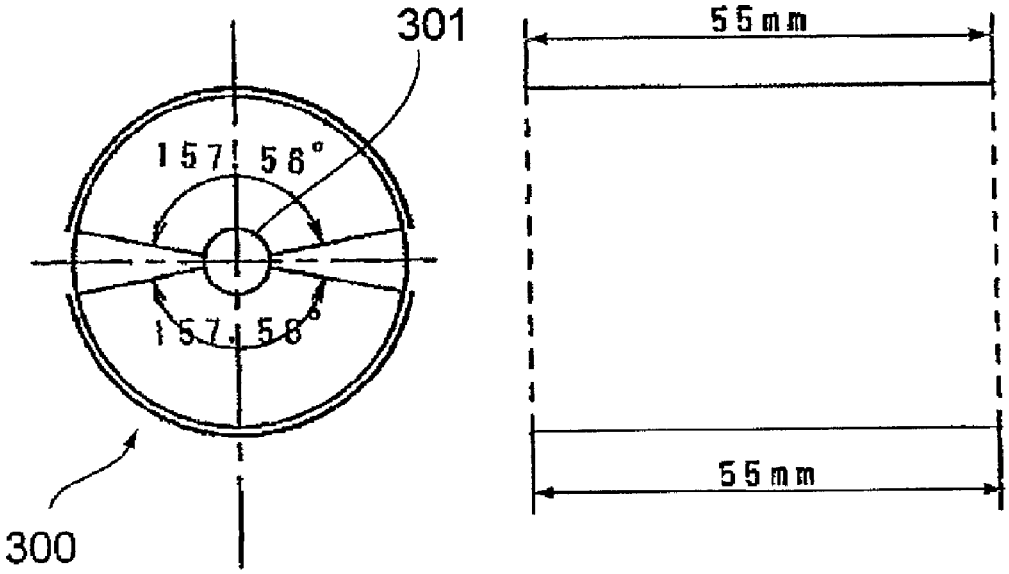

The calculation unit 110 detects (calculates) a skew feeding amount X based on the delay amount or the advance amount in the sheet conveying direction of both the edges in the sheet width direction of the sheet S illustrated in FIG. 8 by a skew feeding amount calculation unit 110*a* as a deviation amount detection unit based on the skew detection signal.

Next, the thus calculated skew feeding amount X illustrated in (d) of FIG. 2 is then input to a control amount setting unit 110*b*. The control amount setting unit 110*b* sets the sheet conveying speed (hereinafter, called a corrected conveying speed) V2 of the skew feeding correction rollers 122*a*, 122*b* and a correction time T necessary to skew feeding correction using expressions (7) and (8) to be described later so that the skew feeding of the sheet can be corrected.

Next, a control signal is input to a motor controller 120 based on the corrected conveying speed V2 and the correction time T calculated and set by the control amount setting unit 110*b* as illustrated in (e) of FIG. 7, and the revolution speeds of the pulse motors 121*a*, 121*b* are controlled through the motor controller 120. With this operation, the peripheral speed of the correction roller 122*a* on the front side can be made different from that of the correction roller 122*b* on the rear side as illustrated in FIG. 8. As a result, the conveying amount of the sheet S on the front side is made different from that on the rear side, thereby the skew feeding of the sheet S can be corrected.

Next, a method of making a difference between the peripheral speed of the correction roller 122*a* on the front side and that of the correction roller 122*b* on the rear side will be described.

It is assumed here that the calculated skew feeding amount X corresponds to the delay amount in the first embodiment described already. Further, it is assumed that the two skew feeding correction rollers 122*a*, 122*b* have a radius R and an ordinary sheet conveying speed is represented by V1. In the second embodiment, the sheet conveying speed of the skew feeding correction roller 122*a* on the front side is set to the sheet conveying speed V1, which is a fixed speed before a certain skew feeding is detected, and the sheet conveying speed of the skew feeding correction roller 122*b* on the rear side when it performs a skew feeding correction operation is set to the corrected conveying speed V2.

When the corrected conveying speed V2 of the skew feeding correction roller 122*b* on the rear side and the correction time T thereof are set, the sheet conveying speed V1 of the skew feeding correction roller 122*a* on the front side, the corrected conveying speed V2, the skew feeding amount X, and the correction time T are controlled so that the relation therebetween satisfies the following expression (5).

$$V1T-V2T=(V1-V2)T=X \tag{5}$$

Further, skew feeding is corrected using the outer peripheral surface of the roller when it rotates once also in the second embodiment to eliminate the adverse effect of the dispersion of the corrected conveying speed caused by the decentering of the roller described already. More specifically, the correction time T is set as a time necessary to correct the skew feeding using the outer peripheral surface of the skew feeding correction roller 122*b* on the rear side when it rotate once so that the skew feeding of the sheet is corrected within the correction time T.

The relation between the corrected conveying speed V2 and the correction time T at this time is represented by the following expression.

$$T=2n\pi R/V2 \ldots \text{(n is an integer)} \tag{6}$$

More specifically, the control amount setting unit 110*b* first determines the correction time T and the corrected conveying speed V2 which satisfy the expressions (5) and (6), and the skew feeding of the sheet can be corrected by driving the skew feeding correction roller 122*b* on the rear side using the values.

When it is assumed that n is 1, the following expressions (7), (8) can be obtained from the expressions (5), (6).

$$V2=\frac{2\pi R}{X+2\pi R}V1 \tag{7}$$

-continued $$T = \frac{X + 2\pi R}{V1} \quad (8)$$

When the correction roller 122*b* on the rear side is driven using the correction time T and the corrected conveying speed V2 determined as described above, the skew feeding of the sheet can be accurately corrected without being adversely affected by the decentering of the skew feeding correction roller 122*b*. With this operation, the sheet can be conveyed in an proper attitude to a transfer portion composed of the photosensitive drum 221 and the transfer charger 222. As a result, the accuracy of the position at which an image is formed on the sheet can be improved.

Note that the case, in which skew feeding is corrected by rotating the correction roller 122*a* on the front side at the fixed speed and the correction roller 122*b* on the rear side at an increased or decreased speed, is described heretofore. However, there are considered various methods such as a method of increasing the speed of the roller on a delay side and decreasing the speed of the roller on a fast side at all times, a method of using a speed between the fast side and the delay side in addition to the above method. However, any of the methods can be applied to the present invention.

Note that although the second embodiment describes the skew feeding correction unit 218 disposed to the sheet conveying apparatus 204, the second embodiment can be also applied to, for example, a registration correction unit disposed to the original feeder of the image reading apparatus described already.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-085849, filed Mar. 28, 2007, which is hereby incorporated by reference herein in its entirety.

What is claimed is:

1. A sheet conveying apparatus, comprising a sheet conveying roller which conveys a sheet and corrects a delay or an advance of the conveyed sheet by increasing or decreasing the sheet conveying speed of the sheet conveying roller, comprising:

a deviation amount detection unit which detects a delay amount or an advance amount of the conveyed sheet; and a control amount setting unit which sets, when the delay or the advance of the sheet is corrected, the sheet conveying speed and the correction time of the sheet conveying roller based on the delay amount or the advance amount of the sheet detected by the deviation amount detection unit, wherein when the sheet conveying speed of the sheet conveying roller before the deviation amount detection unit detects the delay amount or the advance amount of the sheet is represented by V1, the delay amount or the advance amount of the sheet detected by the deviation amount detection unit is represented by X, the radius of the sheet conveying roller is represented by R, the correction time is represented by T, and the sheet conveying speed of the sheet conveying roller in a correction operation is represented by a conveying speed V2, the control amount setting unit sets the sheet conveying speed V2 and the correction time T of the sheet conveying roller so that the following expressions are satisfied;

$$V1T - V2T = X$$

$$T = 2n\pi R/V2 \ldots \text{(n is an integer).}$$

2. A sheet conveying apparatus comprising a sheet conveying roller which conveys a sheet and corrects a delay or an advance of the conveyed sheet by increasing or decreasing the sheet conveying speed of the sheet conveying roller, comprising:

a deviation amount detection unit which detects a delay amount or an advance amount of the conveyed sheet; and a control amount setting unit which sets, when the delay or the advance of the sheet is corrected, the sheet conveying speed and the correction time of the sheet conveying roller based on the delay amount or the advance amount of the sheet detected by the deviation amount detection unit, wherein:

the sheet conveying roller is a plurality of skew feeding correction rollers disposed axially in a width direction orthogonal to a sheet conveying direction and independently driven in rotation, respectively; and the deviation amount detection unit is disposed in the width direction and detects the delay amount or the advance amount of a sheet being conveyed in both the edges thereof in the sheet width direction using the signals from a plurality of detection sensors which detect the extreme ends of the sheet, respectively; and when the skew feeding amount of the sheet detected based on the delay amount or the advance amount of the sheet being conveyed in both the edges thereof in the sheet width direction detected by the plurality of detection sensors is represented by X, the radius of the skew feeding correction roller on the side where the skew feeding of the sheet is corrected is represented by R, a correction time during which the skew feeding of the sheet is corrected is represented by T, the sheet conveying speed of the skew feeding correction roller on the side where the skew feeding of the sheet is corrected before a skew feeding correction operation is performed is represented by V1, and a sheet conveying speed when the skew feeding correction operation is performed is represented by V2, the control amount setting unit sets the sheet conveying speed V2 and the correction time T of the skew feeding correction roller on the side where the skew feeding of the sheet is corrected so that the following equations are satisfied;

$$V1T - V2T = X$$

$$T = 2n\pi R/V2 \ldots \text{(n is an integer).}$$

3. An image forming apparatus, comprising:

an image forming unit which forms an image on a sheet; and the sheet conveying apparatus according to claim 1 which conveys the sheet to the image forming unit.

4. An image reading apparatus, comprising:

an image reading unit which reads an image of a sheet; and the sheet conveying apparatus according to claim 1 which conveys a sheet to the image reading unit.

5. An image forming apparatus, comprising:

an image forming unit which forms an image on a sheet; and the sheet conveying apparatus according to claim 2 which conveys the sheet to the image forming unit.

6. An image reading apparatus, comprising:

an image reading unit which reads an image of a sheet; and the sheet conveying apparatus according to claim 2 which conveys a sheet to the image reading unit.

* * * * *